United States Patent [19]

Phillips et al.

[11] 4,050,256

[45] Sept. 27, 1977

[54] MINE ROOF SUPPORT CONTROL SYSTEMS

[75] Inventors: Reginald Andrew Phillips, Skelmersdale; Kenneth Darbyshire, Wigan, both of England

[73] Assignee: Gullick Dobson Limited, Wigan, England

[21] Appl. No.: 635,148

[22] Filed: Nov. 25, 1975

[30] Foreign Application Priority Data

July 29, 1975 United Kingdom ..... 31625/75

[51] Int. Cl.[2] ..... E21D 15/44

[52] U.S. Cl. ..... 61/45 D

[58] Field of Search ..... 61/45 D; 299/11, 31, 299/32, 33; 91/1, 189, 170 MP

[56] References Cited

U.S. PATENT DOCUMENTS

| | | | |
|---|---|---|---|
| 3,202,058 | 8/1965 | Bolton et al. | 61/45 D X |
| 3,207,041 | 9/1965 | Phillips | 61/45 D X |
| 3,285,015 | 11/1966 | Carnegie et al. | 61/45 D |
| 3,507,122 | 4/1970 | Schmidt | 61/45 D |
| 3,643,445 | 2/1972 | Schmidt | 61/45 D |
| 3,821,880 | 7/1974 | Weirich et al. | 61/45 D |
| 3,906,738 | 9/1975 | Weirich et al. | 61/45 D |

*Primary Examiner*—Dennis L. Taylor

*Attorney, Agent, or Firm*—Berman, Aisenberg & Platt

[57] ABSTRACT

A control system for a self-advancing mine roof support includes function selection hydraulic valve means responsive to coded electrical signals from remote means for selecting a desired function, and means for comparing the coded signals with other signals representing the instantaneous function state of the valve means. Usually each of a plurality of supports incorporates the remote means of a neighboring support.

16 Claims, 2 Drawing Figures

MINE ROOF SUPPORT CONTROL SYSTEMS

Figure 1:
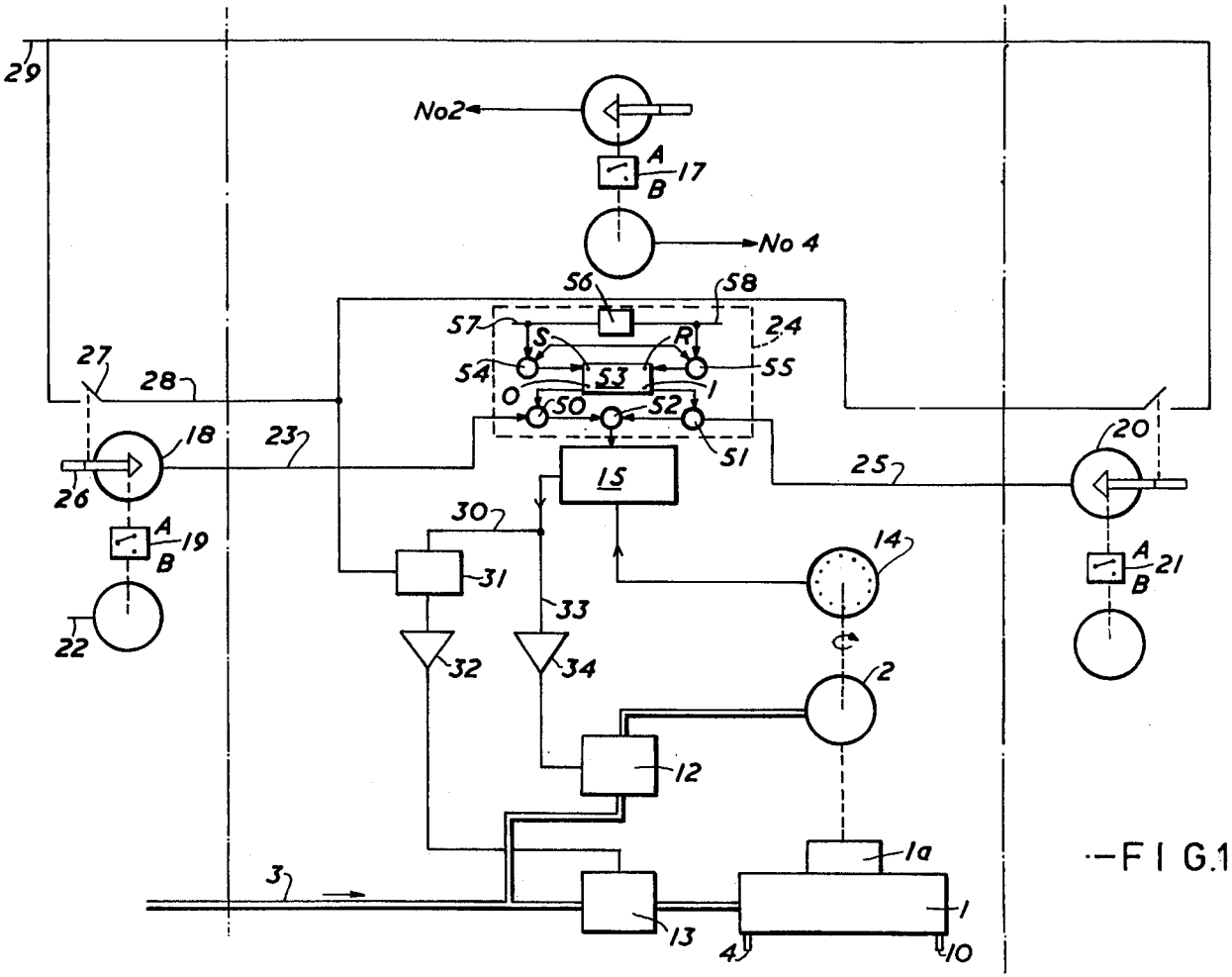

The present invention relates to self-advancing mine roof support control systems and in particular to such systems enabling an operator to control the advance of a support from a relatively safe location.

Such systems are known in which the hydraulic circuits for operating a roof support are extended so that the valve equipment controlling such circuits can be located at a point spaced away from the support, for example on an adjacent support in a support system so that an operator can control the release, advancing and resetting or other function of one support whilst protect by the adjacent support structure. Such systems are somewhat cumbersome because of the number, length and size of the hydraulic hoses which have to be led from the support being controlled to the support housing the control gear. To overcome this drawback to some extent it has been proposed to locate the control valves on the support and control them by means of additional valves responsive to pilot hydraulic pressures applied from control gear located on an adjacent support so that a single multiple-channel hose can be used to couple the control gear on one support to the control valve assembly on an adjacent support.

It is the object of the present invention to achieve remote control of the hydraulic valve gear of a self-advancing mine roof support without the disadvantages of hydraulic circuits extending between the operator location and the support being controlled by arranging for the hydraulic valve gear to be controlled by coded electrical signals transmitted from the operator location over control circuits extending between such location and the valve gear. With the removal of cumbersome hydraulic circuits bi-directional control i.e. control of one support either from the support to its right hand or from the support to its left hand can also be more readily achieved.

According to the invention there is provided a control system for a self-advancing mine roof support, comprising function selection hydraulic valve means responsive to coded electrical signals from remote means for selecting a desired function, and means for comparing the coded signals with signals representing the instantaneous function state of the valve means.

Preferably, the valve means is position controlled, the coded signals specify a desired position, and the other signals represent actual position of the valve means. Where at least part of the valve means is rotatable for position adjustment, means may be provided rotatable therewith to supply the other signals.

The remote means may, advantageously, be arranged to provide a further, enabling signal for controlling implementation even of a selected function. Such control may be via an AND-gate having inputs for both the enabling signal and output of the means for comparing. The enabling signal is conveniently from a deadman device at the remote means.

The remote means can be disposed on another, preferably adjacent, mine roof support. Each such remote means advantageously comprises coded signal generating means and directional switching means for applying the signals to one or other adjacent support. Then each support may have routing circuitry, for example exclusive -OR controlled, to pass only one set of coded signals at any one time. In this way, each of a row of supports at a working face can be operated from either adjacent support.

Figure 2:
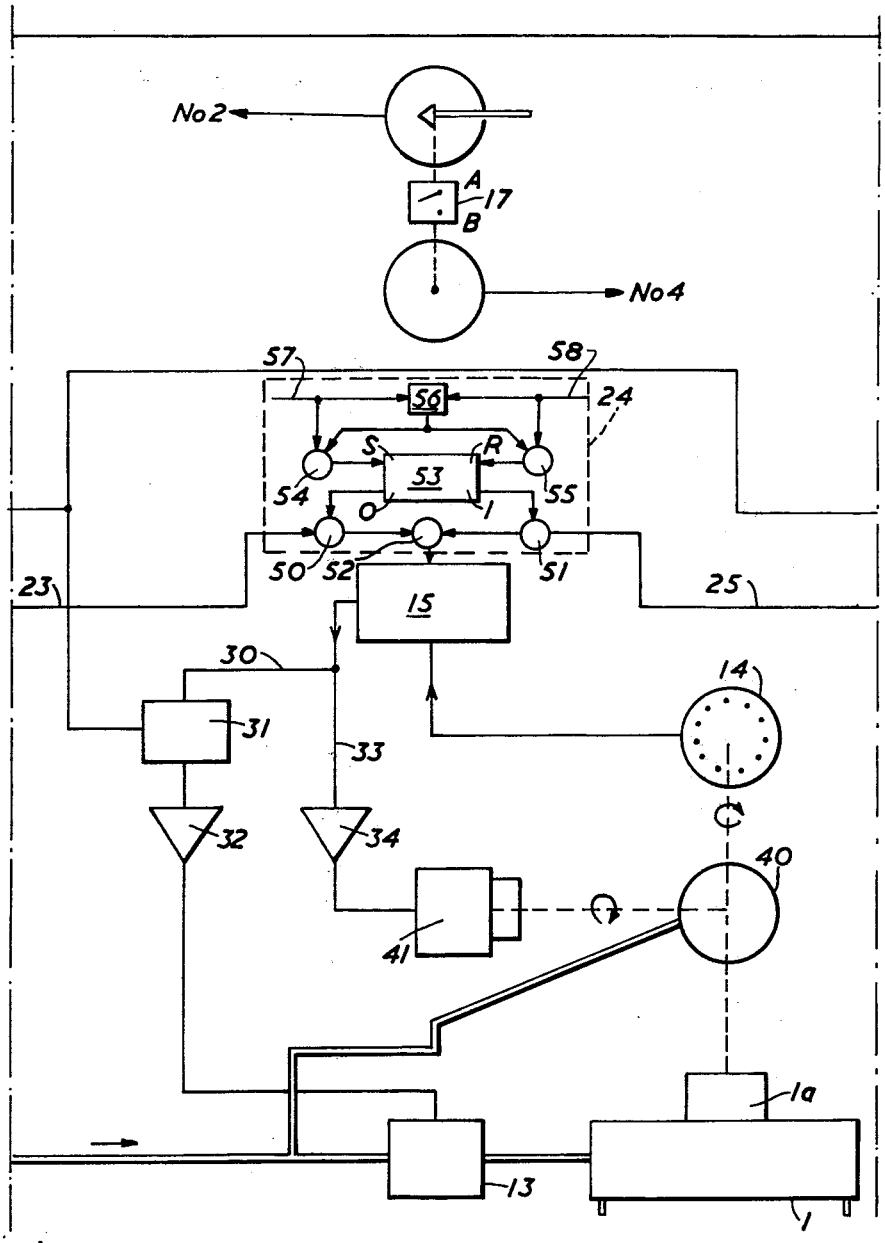

The various features and advantages of the invention will be apparent from the following description of exemplary embodiments thereof illustrated in the accompanying drawings of which:

FIG. 1 is a schematic diagram of one form of control system embodying the invention, and FIG. 2 shows a modification of the system of FIG. 1.

In FIG. 1 the vertical chain-dotted lines indicate the boundaries of the areas occupied by adjacent supports, the double lines indicate hydraulic lines, the single lines indicate electrical lines and the dotted lines indicate mechanical links. The support between the two vertical chain-dotted lines is assumed to be Support No. 3 and has Support No. 2 to its left hand and Support No. 4 to its right hand. Details of the supports themselves are not shown in the drawings but it is assumed that the control of such supports involves a plurality, for example seven, separate functions all controlled by hydraulic control gear indicated by the block 1 having a rotary hydraulic path selector part 1*a*. Function selection is effected by a hydraulic motor 2 serving to rotate a valve as a selective distributor of hydraulic pressure from supply line 3 to any one or combination of, for example seven, input lines 4 to 10 of the valve gear 1. Control of the application of hydraulic fluid flow from line 3 to motor 2 is effected by a solenoid valve 12 and control of the application of hydraulic fluid flow from line 3 to the valve gear 1 to effect a selected function is effected by a further solenoid valve 13, such as the "dead man" valve of a composite structure with the gear 1. The shaft of hydraulic motor 2 carries a coded signal generator 14 the output of which, indicating the angular position of the motor shaft and thus the function currently selected, is applied to an electronic comparator circuit 15, the function of which will be described later. Support No. 3 carries a manually operable function selector 16 and direction switch 17 by means of which the operations of either Support No. 2 or Support No. 4 can be controlled from the relative safety of Support No. 3. Corresponding function selectors and direction switches 18, 19 and 20, 21 for the control of Support Nos. 1 and 3 and Support Nos. 3 and 5 are carried respectively by Support Nos. 2 and 4 and the control of Support No. 3 from Support No. 2 will now be described to demonstrate control from either adjacent support.

To control advancing of Support No. 3 from Support No. 2, the operator first operates direction switch 19 to position A thereby isolating the coded signal generator forming part of function selector 18 from line 22 over which such selector could, alternatively, be used to control advancing of Support No. 1 (not shown) to the left of Support No. 2, and connecting such signal generator to a common supply line 29 extending along the whole series of supports. This also applies energisation over line 23 to an exclusive -OR controlled routing circuit 24 forming part of the electronic control arrangements on Support No. 3 and thence to the generator 14. The purpose of circuit 24 is to prevent control of Support No. 3 by the function selector 20 of Support No. 4 over line 25 once control from Support No. 2 has been established, and vice versa.

As shown, the routing circuit has AND gates 50, 51 in the coded signal line 23, 25 with outputs connected to an OR gate set 52 for supplying the comparator 15, which the AND gate sets 50, 51 is enabled depends on the state of a bi-stable device 53 and that, in turn, depends on outputs from AND gates 54 and 55 connected to its set at reset inputs respectively. AND gates 54 and 55 both have one input connected to the output of an exclusive -OR gate or half adder 56. The other inputs of the AND gates 54 and 55 are connected to busy signal lines 57 and 58, respectively, for indicating that the down (No. 2) or up (No. 4) support is supplying control signals. These lines 57 and 58 are also taken to inputs of the exclusive -OR gate 56. The lines 57 and 58 may comprise the dead man lines 28 from each adjacent support, or they may be separate ones of a plurality of lines 23, or they may be derived, for example using an -OR gate, from the coded signal lines 23 which may be one for each function or be binary coded and have, say, an all-zero state representative of no command.

In operation, neither of the AND gates 54 and 55 can be enabled if the other is already enabled as the exclusive -OR output will go low when both its imputs are high thereby disabling both of the AND gates 54 and 55. The bistable device 53 serves to remember which of the lines 57 and 58 first went high and can only be put to its other state after that line goes low.

In operation, the operator rotates the selector arm of function selector 18 to a position corresponding to the function desired to be performed. The coded electric signal indicative of the function selected by the operator is now applied from the signal generator of selector 18 over line 23 to routing circuit 24 from where it passes to comparator 15 to be compared with the signal received by such comparator from generator 14 and, if the motor 2 is already in the position corresponding to the selected function fed into the comparator 15, and AND gate device 31 then allows energising of solenoid valve 13 through amplifier 32 provided contacts 27 are closed by the action of the deadman control 26 over line 28 to the common supply line 29.

Actuation of valve 13 applies hydraulic pressure-fluid from line 3 to valve block 1 to cause performance of the selected function. If the motor 2 is not in the position corresponding to the selected function the output of comparator 15 over line 33 controls amplifier 34 to energise solenoid valve 12. Actuation of valve 12 applies hydraulic pressure-fluid from line 3 to motor 2 to drive such motor in search of the selected function position and when such position is found the resultant change in output from comparator 15 de-energises valve 12 and allows energisation of valve 13 to cause performance of the selected function, by the closing of the contacts 37 by the deadman control. In the case referred to, selector 18 may be operated if selector 20 is in the neutral position, for example if selector 18 is on a legs lower position and the switch 19 is in a position 'A' then control 20 may not be used to operate No. 3 until either selector 18 is in its neutral position or switch 19 is moved the position B either of these actions allows 20 to take over the control function, providing 21 is in position A. Thus from the example given selector 18 in legs lower position, selector 20 in the ram advance position, then changing 19 to position B on 18 to neutral allows selector 20 to take command and the generator 14 now homes on the ram advance position but no further action will take place until the deadman control 26*a* closes the contacts 27*a*.

FIG. 2 shows a modification of the arrangements shown in FIG. 1 for the control of valve block 1 using only one solenoid valve. In this modified arrangement the hydraulic supply line 3 is connected directly to a hydraulic rotary positional servo-mechanism 40, which replaces the motor 2 of FIG. 1, and the solenoid valve 12 of FIG. 1 is replaced by an electric motor and gear box 41 energised under the control of amplifier 34. In this modified arrangement while the comparator 16 is yielding a difference output motor 41 will be energised and will provide a low power mechanical drive to the hydraulic servo-mechanism 40 which will be effectively amplified and applied to rotate the function selector shaft by the servo-mechanism until the selected function position is found whereupon the output of comparator 15 changes, the motor 41 stops and valve 13 is energised as before.

The shaft connecting servo-mechanism 40 and generator 14 may be extended to carry indicating means giving a visual indication of the function selected and to provide manual override operating means for the valve block 1 for emergency use and/or initial installation of supports.

Whilst in the foregoing description control of each support from a next adjacent support only has been considered, it will be appreciated that the same control system could readily be applied for control from a more remote point than the adjacent support. From a more remote point however the facility of visual supervision of the response of a support to the operator's actions, available when control is exercised from an adjacent support, is no longer available and some form of monitoring of the actual operations of the support members would be required. Since, however, the wires needed between a support and its control point in putting the system of the invention into effect are of relatively small size and do not present the same problems as hydraulic circuits extending between support and control point, the provision of additional wires for electrical supervisory purposes, or the use of the control wires for supervisory purposes on a time division multiplexing basis, does not present any great problem.

We claim:

1. A control system for at least one self-advancing mine roof support comprising: remote selection means for providing a plurality of different coded electrical signals each of which represents a different desired function of said support, means interconnecting said remote selection means with apparatus at said support, said apparatus comprising function selection pressure fluid valve means responsive to at least one of said coded electrical signals for selecting a desired function of said support, signal generating means coupled to said valve means for generating a similar coded electrical signal which represents the instantaneous function state of said valve means, and comparator means connected to receive said at least one coded electrical signal from said remote selection means and said similar coded electrical signal from said signal generating means for determining when said valve means corresponds to said at least one coded electrical signal from said remote selection means.

2. A system according to claim 1, wherein said valve means is position controlled, and means are further provided to drive said valve means through positions corresponding to functions of said support, and wherein said coded electrical signals each specify a desired position of said valve means while said similar coded electrical signal represents the actual position of said valve means.

3. A system according to claim 2, wherein at least part of said valve means is rotatable, and further comprising means rotatable therewith to supply said similar coded electrical signals.

4. A system according to claim 1, wherein said apparatus further comprises enabling means connected to be responsive to the output from the comparator means and to a further signal from said remote selection means for either allowing or inhibiting implementation of a support function specified by the valve means at any one time.

5. A system according to claim 4, wherein said enabling means comprises an electronic AND gate having inputs connected to receive said further signal and for the output from the comparator means, and an output connected to control pressure fluid supply control means.

6. A system according to claim 5, wherein said apparatus further comprises a solenoid valve connected to receive the AND gate output and located in a hydraulic fluid supply line to said valve means.

7. A system according to claim 4, further comprising a deadman device associated with said remote selection means, and means associated with said deadman device for supplying said further signal.

8. A system according to claim 1, wherein said comparator means has its output connected to means for controlling application of hydraulic fluid to means for driving the valve means.

9. A system according to claim 8, wherein said means for controlling application of hydraulic fluid comprises a solenoid valve which is located in a hydraulic fluid supply line to means for driving said valve means.

10. A system according to claim 9, wherein said means for driving said valve means comprises a hydraulic rotary positional servo-mechanism and an electric motor and gear box coupled to drive the servo-mechanism according to said output of said comparator means.

11. A system according to claim 1, wherein said mine roof support further includes remote means for selecting a desired function for a different mine roof support, and further comprising means for interconnecting same to said different support.

12. A system according to claim 11, in which said remote means comprises coded signal generating means and a directional switch for applying the coded electrical signals generated by said coded signal generating means one at a time to two other similar mine roof support via interconnection means.

13. A system according to claim 1, wherein said apparatus further comprises means for passing to the comparator means signals one at a time from at least two different remote means for selecting a desired function.

14. A system according to claim 13, wherein the means for passing is an exclusive -OR controlled routing circuit.

15. A system according to claim 1, wherein said remote selection means is disposed on a different self-advancing mine roof support from the one whose functions it is controlling.

16. A system according to claim 15, wherein said different mine roof support is adjacent to said at least one mine roof support.

* * * * *